US006283492B1

(12) United States Patent
Hale

(10) Patent No.: US 6,283,492 B1
(45) **Date of Patent: *Sep. 4, 2001**

(54) SNOWBOARD BINDING SYSTEM AND A SNOWBOARD STEP-IN BOOT SYSTEM WITH GRADUALLY INCREASING RESISTANCE

(76) Inventor: Noah W. Hale, P.O. Box 1709, Conway, NH (US) 03818

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/845,109

(22) Filed: Apr. 21, 1997

Related U.S. Application Data

(60) Provisional application No. 60/033,925, filed on Dec. 27, 1996.

(51) Int. Cl.[7] ..... A63C 9/08

(52) U.S. Cl. ..... 280/611; 280/14.2; 280/11.36

(58) Field of Search ..... 280/14.2, 630, 280/634, 620, 611, 626, 11.2, 11.36; 36/118.2, 118.3, 118.4

(56) References Cited

U.S. PATENT DOCUMENTS

| | | | | |
|---|---|---|---|---|
| 3,619,914 | * | 11/1971 | Hanson et al. | 36/118.2 |
| 3,870,325 | * | 3/1975 | Davis | 280/611 |
| 4,002,354 | | 1/1977 | Ramer . | |
| 4,060,256 | * | 11/1977 | Collombin et al. | 280/613 |
| 4,367,885 | | 1/1983 | Ramer . | |
| 4,501,078 | * | 2/1985 | Kopp | 36/118.3 |
| 4,887,833 | * | 12/1989 | Bailey | 280/620 |
| 4,889,358 | | 12/1989 | Rullier . | |
| 4,991,319 | * | 2/1991 | Perner | 36/118.3 |
| 5,020,823 | | 6/1991 | Bogner . | |
| 5,175,949 | | 1/1993 | Seidel . | |
| 5,261,689 | | 11/1993 | Carpenter et al. . | |
| 5,276,982 | | 1/1994 | Wittman . | |
| 5,344,179 | | 9/1994 | Fritschi et al. . | |
| 5,386,650 | | 2/1995 | Storz . | |
| 5,435,080 | | 7/1995 | Meiselman . | |
| 5,505,477 | | 4/1996 | Turner et al. . | |
| 5,702,119 | * | 12/1997 | Challande et al. | 280/14.2 |
| 5,722,679 | * | 3/1998 | Challande et al. | 280/630 |
| 5,997,027 | * | 12/1999 | Jungkind | 280/617 |
| 6,032,974 | * | 3/2000 | Saillet | 280/611 |

FOREIGN PATENT DOCUMENTS

| | | |
|---|---|---|
| 6-121862 | 5/1994 | (JP) . |
| 90/11805 | 10/1990 | (WO) . |

* cited by examiner

*Primary Examiner*—Kenneth R. Rice
*Assistant Examiner*—Lynda C. Jasmin
(74) *Attorney, Agent, or Firm*—Mattingly, Stanger & Malur, P.C.

(57) ABSTRACT

One or more energy transfer or resistance elements are attached to a snowboard binding in order to provide gradually increasing resistance and improve performance. According to one embodiment, the resistance element can includes a housing containing a spring and an adjuster block. A bolt is passed through the spring and threaded into the adjuster block for setting a desired amount of tensioning. The angle of a highback is adjusted by a lean adjuster which is also threaded into the adjuster block. According to another embodiment, the resistance element is a strap having an expandable portion. In another embodiment, the strap is combined with the spring in order to provide energy transfer. In yet another embodiment, the resistance element includes a torsion spring. A step-in system as well as an after-market attachment are disclosed.

16 Claims, 12 Drawing Sheets

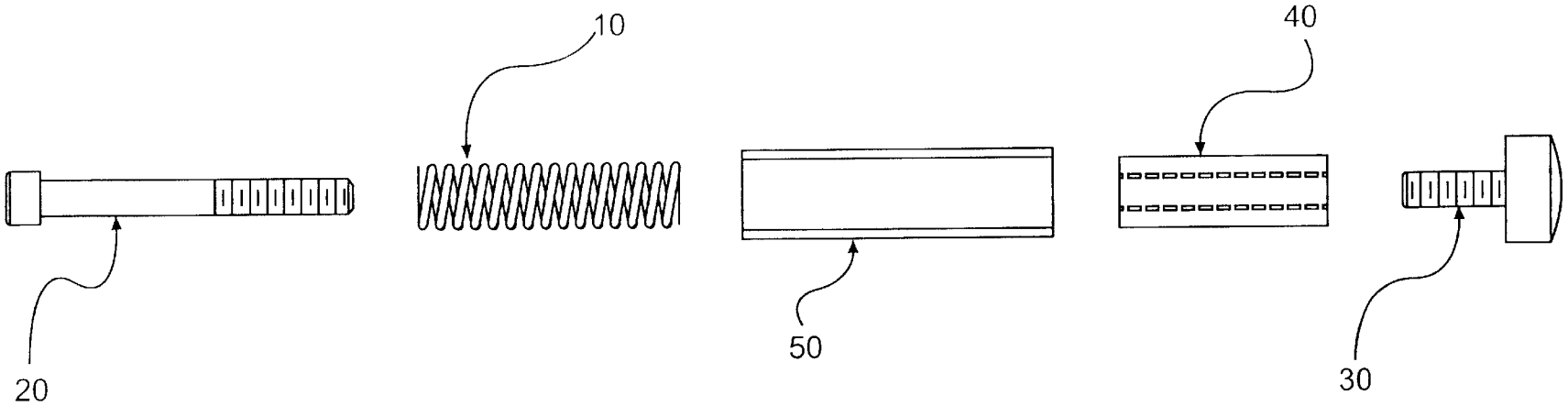
FIG. 4A
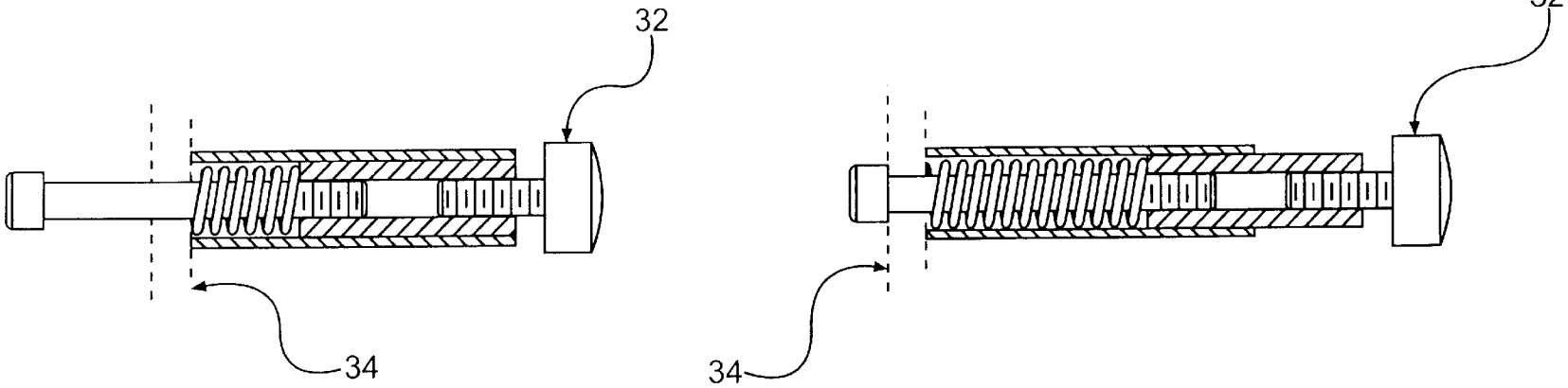
FIG. 4C
FIG. 4B

SNOWBOARD BINDING SYSTEM AND A SNOWBOARD STEP-IN BOOT SYSTEM WITH GRADUALLY INCREASING RESISTANCE

This Application claims benefit of Prov. No. 60/033,925, filed Dec. 27, 1996.

FIELD OF THE INVENTION

The present invention relates to the sport of snowboarding and the boots and bindings used. More specifically, the present invention relates to an energy absorbing and releasing element, or energy transfer element, used in conjunction with a forward lean adjustment element and is incorporated into snowboard boots and bindings, thereby providing a more functional system that improves overall riding performance.

BACKGROUND OF THE INVENTION

Snowboarding is becoming increasingly popular in recent years. Various types of snowboards are currently on the market along with various types of snowboard boots and binding systems. One example of a snowboard boot binding system is shown in U.S. Pat. No. 5,261,689, the disclosure of which is hereby incorporated by reference. In this patent, a binding plate is supported on a snowboard and a highback support is attached to the rear of the binding plate. The highback support can be rotated along an axis generally normal to the binding plate and secured in its rotated position so that a rider can transmit forces to the snowboard from a variety of stances.

SUMMARY OF THE INVENTION

The present inventor has recognized that the snowboard boot binding systems of the prior art are still in need of refinement in order to be enable riders to realize the full potential of their snowboards. Accordingly, the present invention was developed and is based upon an energy absorbing and releasing element such as a spring device, spring combination, or strap, which is designed and intended to make a snowboard more responsive, more stable, and easier to control at higher speeds or under greater amounts of pressure. Also, "on hill" adjustability of both the forward lean and the pre-tension is made possible by the present invention. This allows a rider to set the desired angle of forward lean and the desired stiffness according to the weight flex of his or her snowboard and the ever changing riding conditions.

Furthermore, the apparatus constructed according to the present invention can be incorporated into snowboard bindings and boots in several different ways. It can be molded into the highback (heel and leg support), fit as an after-market attachment, or housed within the base plate (snowboard boot sole support) of the binding along either side of the boot or on either side of the heel. It can also be incorporated into a step-in system in the same fashion, except that in this case it becomes part of the internal skeleton of the boot and not the binding.

BRIEF DESCRIPTION OF THE DRAWINGS

FIGS. 4(*a*)–4(*c*) illustrate the preferred embodiment of the resistance element according to the present invention.

DETAILED DESCRIPTION OF THE PREFERRED EMBODIMENTS

Figure 2:
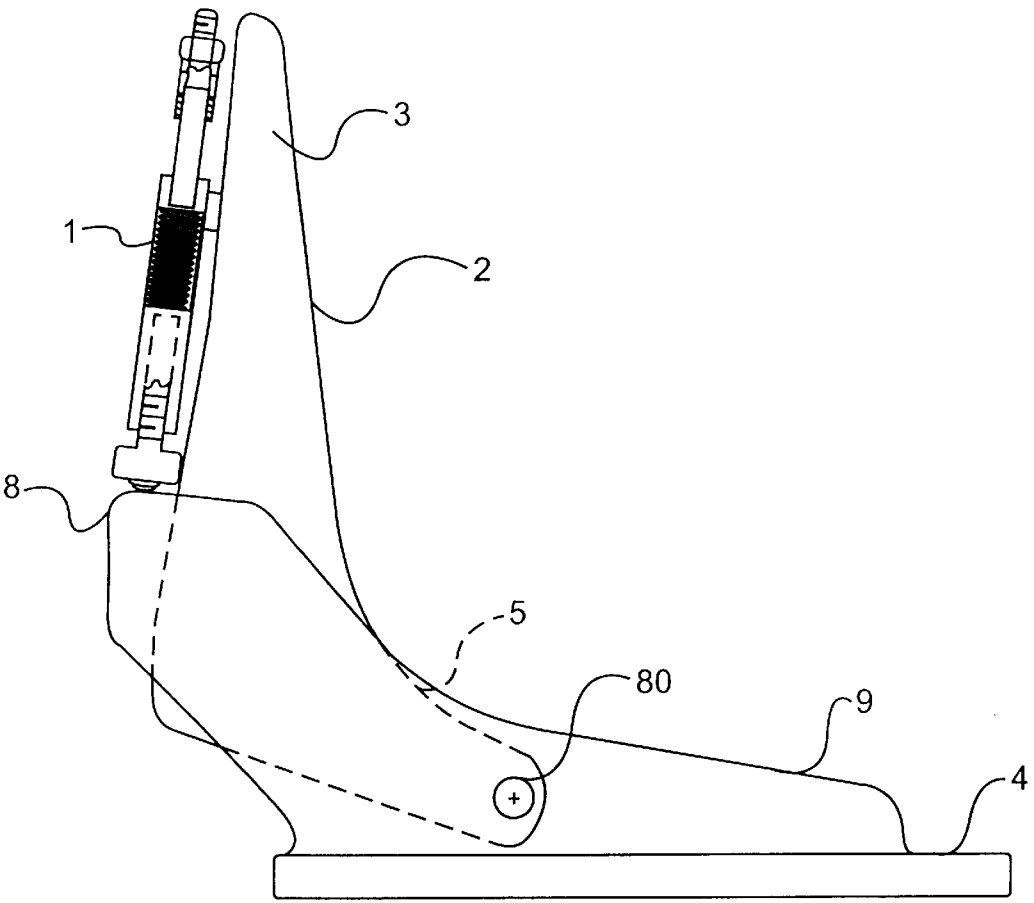
FIG. 2 illustrates a side view of the binding system of FIG. 1 with the highback in a first position.

The preferred embodiments of the present invention will now be described in conjunction with the attached drawings. The drawings illustrate the energy absorbing and releasing or energy transfer system, referred to herein as Gradually Increasing Resistance (GIR) system. More specifically, the system is illustrated as incorporated with a snowboard boot binding system such as that discussed in U.S. Pat. No. 5,261,689, for example. Alternatively, for the step-in system, the GIR system is incorporated into the internal skeleton of the boot itself instead of the binding.

A primary object of the present invention is to provide an energy absorbing and releasing element (energy transfer element) that provides gradually increasing resistance at certain times such as when a rider comes from a toe side turn into a heel side turn. This eliminates hesitation of heel edge initiation by blending the flex of the bindings into the flex of the board throughout the arc of a turn. The gradually increasing resistance is fairly forgiving at first, yet gradually becomes stiffer as a rider pressures the snowboard through a heel edge turn. This makes for a much smoother arc and an increased turning radius.

Another object of the present invention is to give snowboard riders more control and confidence, by employing a forward lean adjuster which isn't set in a fixed position. This allows a rider to increase the angle of forward lean, which brings the rider's center of gravity over his or her board more.

The GIR system also provides a higher level of stability at the apex of a turn. When all of a rider's weight is applied upon the GIR system, the system acts as an independent suspension under each foot, absorbing the shocks from any uneven terrain that is crossed. The GIR system also comes into play when uneven pressure or too much pressure is applied causing the edge of the snowboard to break free from the snow surface. In such cases, the GIR system redistributes pressure, absorbs shock, and reduces chatter. This makes it possible for the side cut and camber of the board to recover allowing riders to complete more aggressive heel side turns with unmatched comfort, energy and control.

All the energy generated while carving a turn is magnified tremendously by the use of the GIR system. This is due to the fact that the bindings are flexing with the board under tremendous pressure. Thus, when the weight is released, both the board and bindings spring up and into the next turn. On the other hand, in the prior art, the rider only gets a little snap force from the board itself. The advantages provided by the present invention are most enjoyable in powder conditions with the GIR on a softer setting, but can also be realized as very beneficial under any condition, especially when leaving the lip of a jump. With the introduction of the GIR system into the sport of snowboarding, performance will be enhanced and the sport will progress to a higher level, thereby permitting riders to realize greater amplitude, speed and control with their snowboards.

The first embodiment of the GIR system is the aftermarket attachment. This attachment would be designed to mount easily onto the back of any freestyle snowboard binding, thereby transforming it into a high end, high performance binding. This first embodiment is illustrated in FIGS. 1–3.

Figure 1:
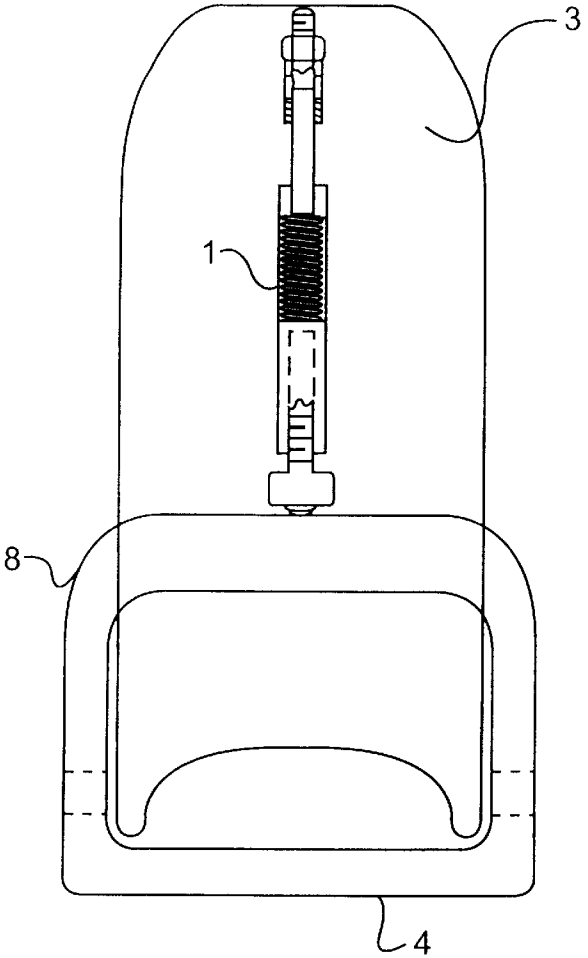
FIG. 1 illustrates a rear view of the binding system according to a first embodiment of the present invention.
Figure 3:
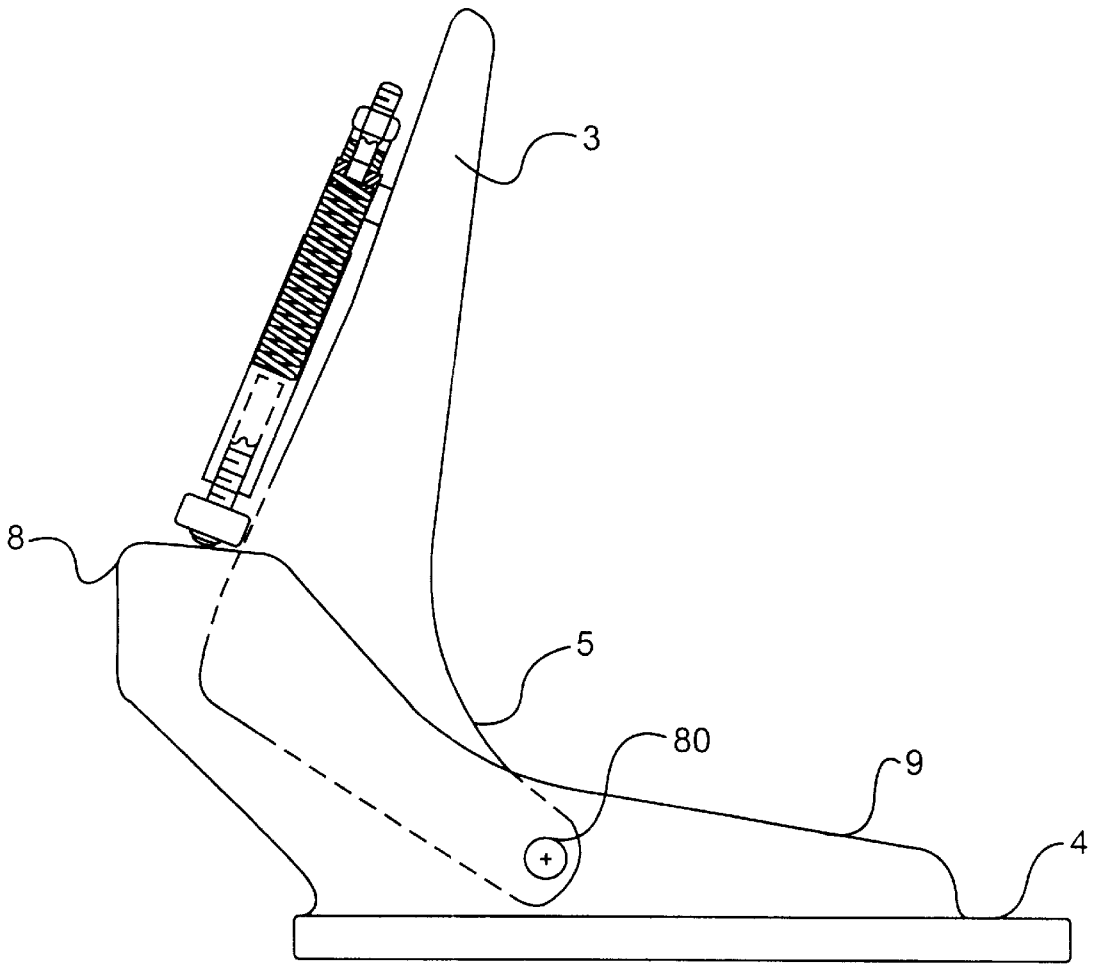
FIG. 3 illustrates a side view of the binding system of FIG. 1 with the highback in a second position.

As shown in FIGS. 1–3, a snowboard binding 2 includes a highback 3 fixed onto a base plate 4. An energy absorbing and releasing element 1, also referred to herein as energy transfer element or resistance element 1, is attached along the rear of the highback 3 and to the upper lip 15 of the heel wall. The method of attaching the resistance element to the highback 3 and the like, where not specifically set forth, is well within the ability of one skilled in the art. Therefore, detailed explanation is not provided. Base plate 4 also has integrally formed side walls 9. FIG. 1 illustrates a rear view of the binding. FIGS. 2 and 3 illustrate side views of the binding with the highback at different angular positions with respect to the base plate.

This single resistance element 1 mechanically functions in a manner similar to the two element embodiment (discussed later) but is intended as an aftermarket attachment, whereas the two element embodiment is preferred when the binding itself is designed to house the GIR system. The two resistance element embodiment is more accurate as far as the distribution and transfer of energy is concerned. Also, the amount of space for the boot in the heel is increased due to the absence of a heel cup as illustrated in FIGS. 5–11.

FIGS. 4(*a*)–4(*c*) illustrate a preferred embodiment of the resistance element 1 of the GIR system. As shown in FIG. 4(*a*), resistance element 1 includes a pre-load bolt 20 which is passed through a control spring 10, threaded into adjuster block 40 and covered by housing 50. Adjuster block 40 is inserted into housing 50 in abutting relationship to the control spring 10. Lean adjuster 30, having a head 32, is operated to move adjuster block 40 against control spring 10. FIG. 4(*b*) illustrates resistance element 1 with control spring 10 in a compressed state against binding 34, while FIG. 4(*c*) illustrates resistance element 1 with control spring 10 in an uncompressed or free state.

Elements in FIGS. 4(*a–c*) will now be discussed in more detail by way of example only. One of ordinary skill in the art would be able to make various modifications and substitutions to the specific parts used herein without departing from the intended scope of the present invention. Control spring 10 can be constructed from regular coil springs in a variety of coil thicknesses, Bellville disc springs, non-linear coil springs, and the like. Also, additional control springs can be provided along both sides of a riders foot at the pivot point 80 (See FIG. 13), where the highback 3 pivots on the base plate 4 for more lateral stability. Such additional control springs would come into play only when the control springs on either side of the heel are almost fully compressed.

If a non-linear coil spring is used as the control spring, it should preferably be custom made, possibly combined with a small stack of Bellville disc springs. The Bellville disc springs would come into use at the apex of a turn, absorbing any unexpected shock or vibrations beyond what other springs had already absorbed. Springs at pivot point 80, if used, would also be useful at this time especially if an unexpected rut or bump is encountered that throws a rider's body weight forward or backward toward the nose or tail of the snowboard, ie. laterally. Several different sizes of control springs should be available for selection based upon the weight of the rider. However, pre-load bolt 20 permits a good range of adjustment.

Pre-load bolt 20 can be a specially designed allen head bolt and is threaded into adjuster block 40 and acts as a guide and pretension adjustment on control spring 10. This enables riders to adjust the stiffness of the GIR system, depending upon their body weight. Adjustment can be made using a small compact tool set which can be carried by the rider for "on-hill" adjustments and repairs.

Figure 6:
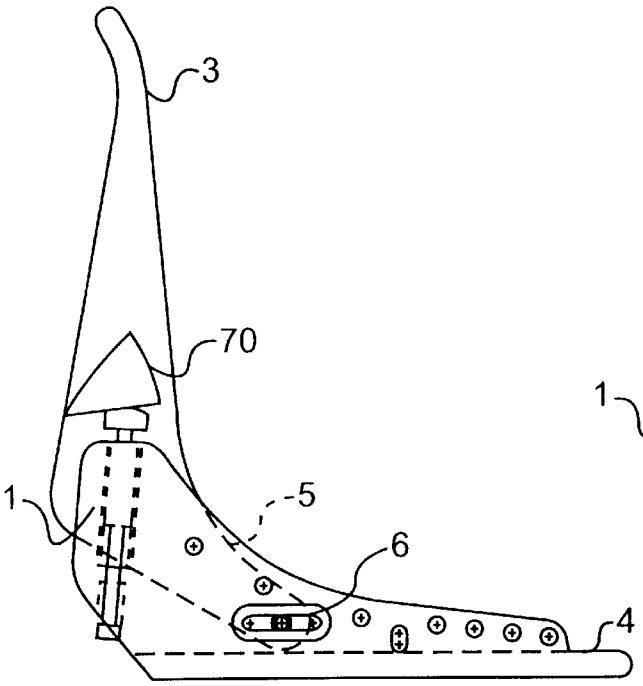
FIG. 6 illustrates a side view of the binding system according to FIG. 5 with the highback in a first position.
Figure 5:
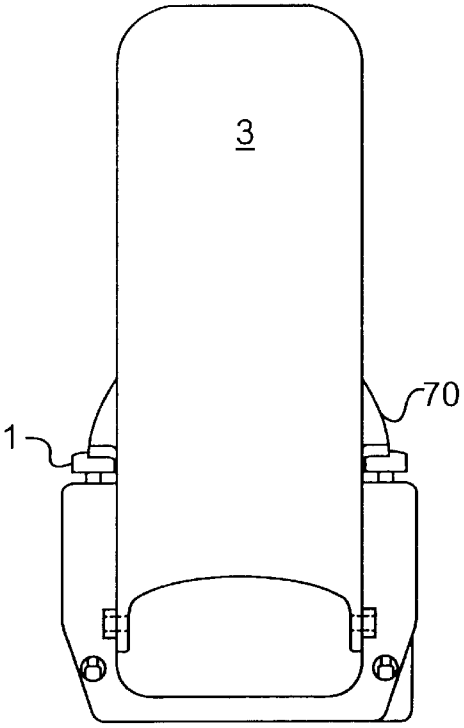
FIG. 5 illustrates a rear view of the binding system according to a second embodiment of the present invention.

Lean adjuster 30 is preferably a knurled, threaded thumbwheel device which allows a rider to adjust the angle of the highback by simply turning the device with the riders fingers. Alternatively, the lean adjuster 30 may be an allen head adjustment so that it would require a tool to turn it. This would make it less likely to vibrate out of position. Lean adjuster 30 is threaded into adjuster block 40 opposite pre-load bolt 20. The top of the lean adjuster contacts a forward lean stop block 70, as shown in FIG. 6, for example. The forward lean stop block 70 is located on either side of the binding, as shown in FIG. 5, and are specially shaped to fit the contour of the binding and to provide a consistent surface so as to prevent the lean adjuster 30 from slipping off. A clearly numbered angle window can be placed above the forward lean stop block 70 to show the rider the angle to which the forward lean is set.

Adjuster block 40 fits securely inside housing 50, which houses the GIR system. Preferably housing 50 has a square-like opening on its inside and a square-like or rectangular shape on the outside, in order to conserve the amount of material used. Of course, other shapes may be utilized depending upon the circumstances and specific needs. The outside shape should match the shape of the GIR pocket 60 (see FIG. 8) for a secure fit.

Figure 14:
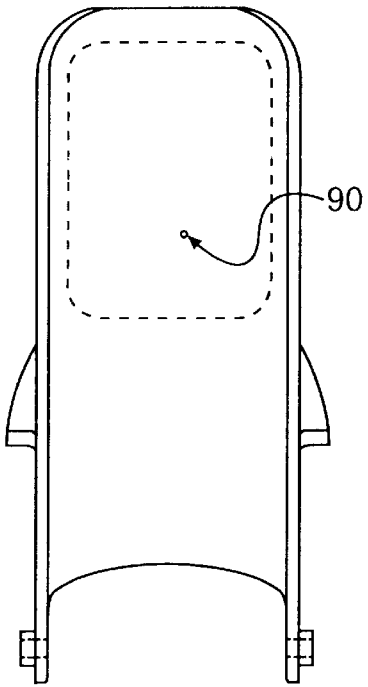
FIG. 14 illustrates a front view of the highback along with the pad area.

A pad area 90, as shown in FIG. 14, may be provided for a specially designed calf pad. The calf pad is designed to cradle the calf muscle for maximum comfort. It is preferably made out of some sort of foam rubber or silicone gel and will conform to the calf region of a rider's leg.

The operation of the GIR system will now be described with respect to the second embodiment of the present invention illustrated by FIGS. 5–14. Instead of one spring pack this embodiment includes two independently adjustable resistance elements 1 housed along either side of the heel cup. The highback has two arms 5 which slide in tracks 6. Because the resistance elements 1 on one side of the boot, heel area and foot area, are independently adjustable in terms of forward lean and pre-tension, they can work together when under pressure, but if necessary will work independently to help compensate for any weight displacement or variations in terrain and pressure.

Figure 18B:
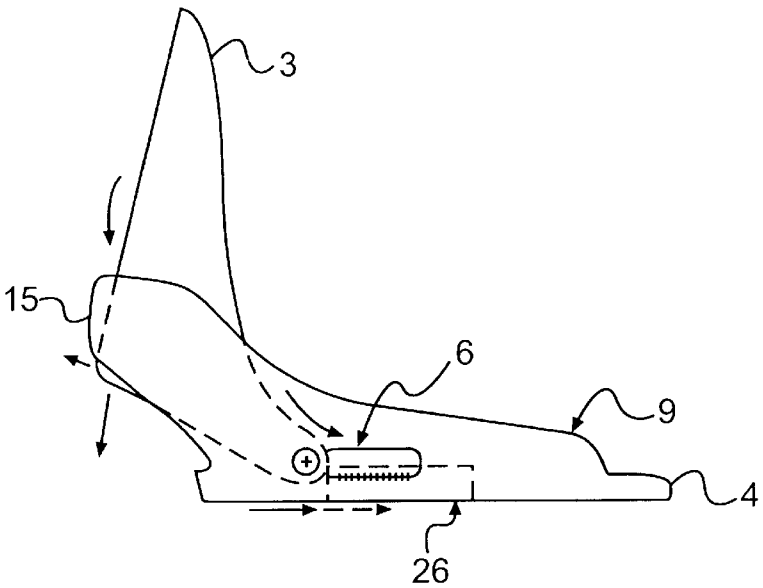
FIGS. 18(*a*) and 18(*b*) respectively illustrate a rear view and a side view of the binding system according to a variation of the present invention.
Figure 18A:
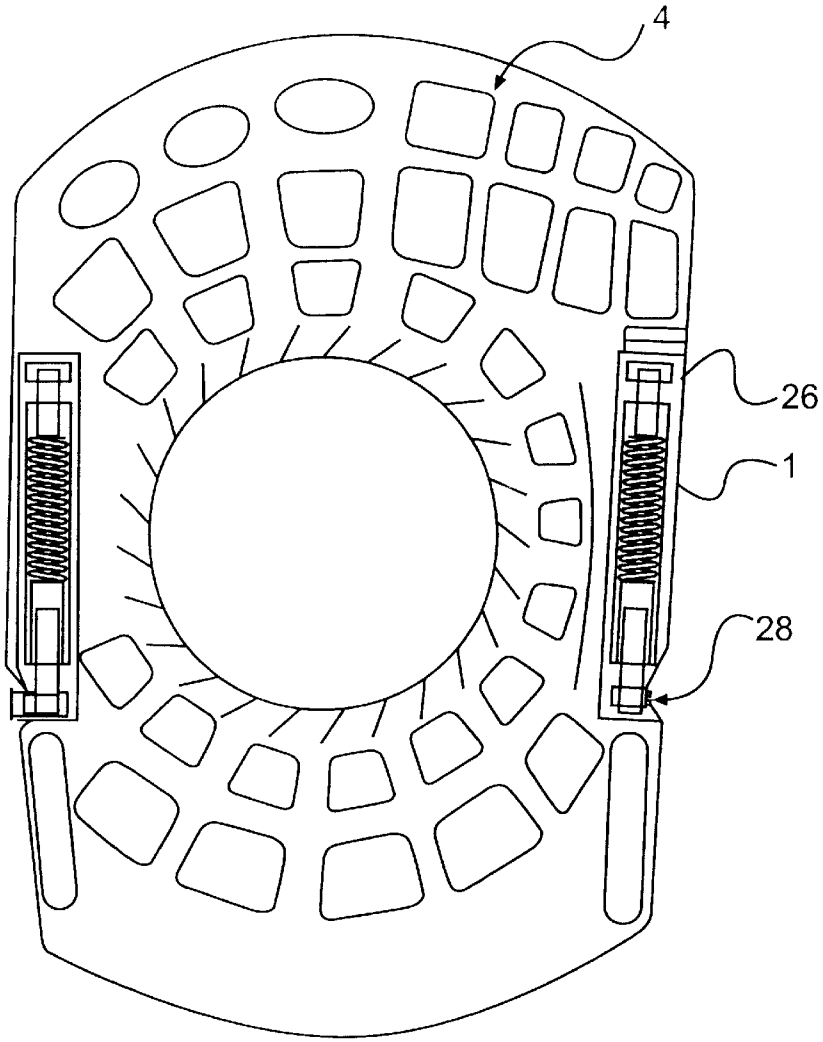

In order to optimize performance, additional resistance elements can be provided along the side of the boot as illustrated in FIGS. 18(*a*) (bottom view) and 18(*b*) (side view), near to where tracks 6 are located. Alternatively, the resistance elements shown in FIGS. 18(*a*) and 18(*b*) can be used by themselves, without using the resistance elements of FIGS. 5–14. FIG. 18(*b*) shows where a track 6 is located. A free bolt is provided in the track so that it can slide and apply force to resistance element 1, which is illustrated in FIG. 18(*b*). Resistance element 1 is preferably provided within a housing 26 molded into baseplate 4. Rachet head 28 is used to provide forward lean adjustment. This results in a modified form of the second embodiment where additional resistance elements 1 are provided as illustrated in FIG. 8.

Figure 7:
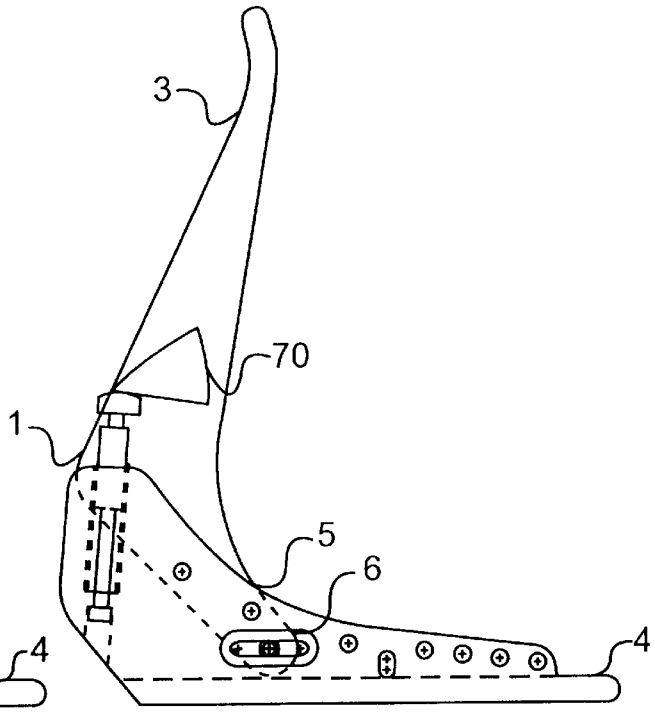
FIG. 7 illustrates a side view of the binding system according to FIG. 5 with the highback in a second position.

Snowboard riders have always had a problem with the highbacks of their snowboards hindering movement while in the air. In the past, riders have cut their highbacks down or turned them so that they are parallel to the heel edge of the snowboard in order to permit a broader range of movement in the air. With the present invention, riders can tweak the highbacks from side to side when in the air. By housing the resistance elements as shown in FIGS. 5–7, a more efficient, and direct transfer of energy is achieved through the bindings and into the snowboard.

Figure 8:
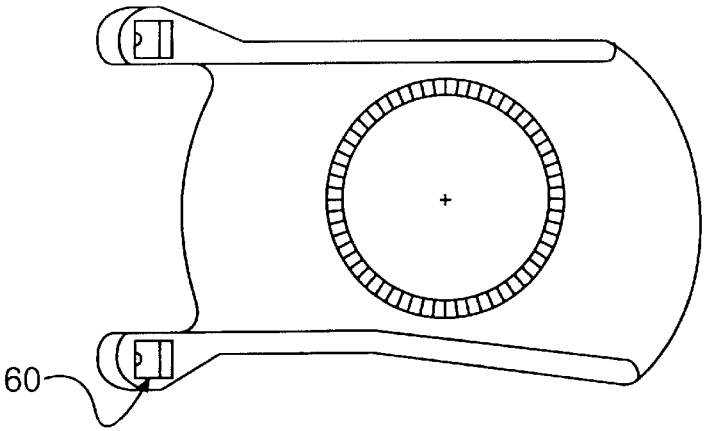
FIG. 8 illustrates a top view of the binding system according to the second embodiment of the present invention.
Figure 9:
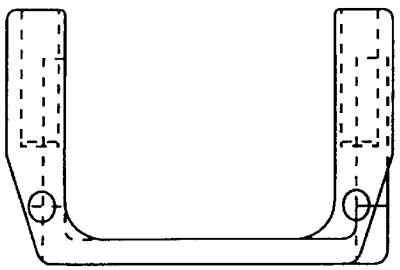
FIG. 9 illustrates the back of the baseplate (heel area shown) where dotted lines indicate where the system according to the present invention will be housed.
Figure 10:
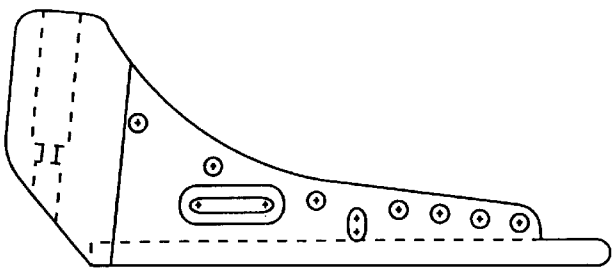
FIG. 10 illustrates a side view of the baseplate where dotted lines indicate where the system according to the present invention will be housed.
Figure 11:
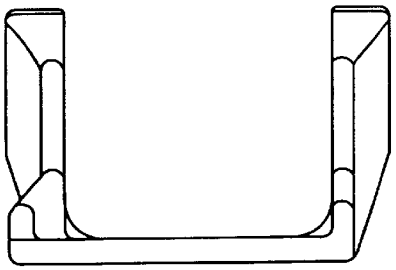
FIG. 11 illustrates a heel area without the dotted lines showing where the system according to the present invention will be housed.
Figure 12:
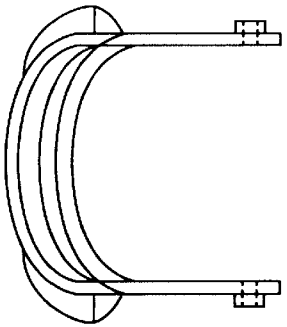
FIG. 12 illustrates a top view of the highback.
Figure 13:
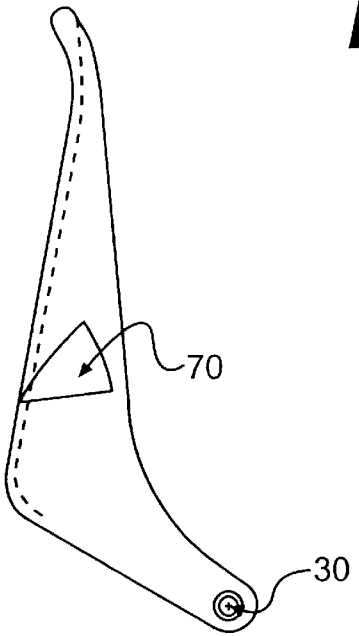
FIG. 13 illustrates a side view of the highback of FIG. 12.

FIGS. 8–14 illustrate various portions of the binding system incorporating the GIR system according to the present invention. Specifically, FIG. 8 illustrates a top view of the binding system according to the second embodiment of the present invention. FIG. 9 illustrates the back of the baseplate (heel area shown) where dotted lines indicate where the system according to the present invention will be housed. FIG. 10 illustrates a side view of the baseplate where dotted lines indicate where the system according to the present invention will be housed. FIG. 11 illustrates a heel area without the dotted lines showing where the system according to the present invention will be housed. FIG. 12 illustrates a top view of the highback. FIG. 13 illustrates a side view of the highback of FIG. 12, showing the positioning of a forward lean stop block 70. FIG. 14 illustrates a front view of the highback along with the pad area 90.

Figure 15:
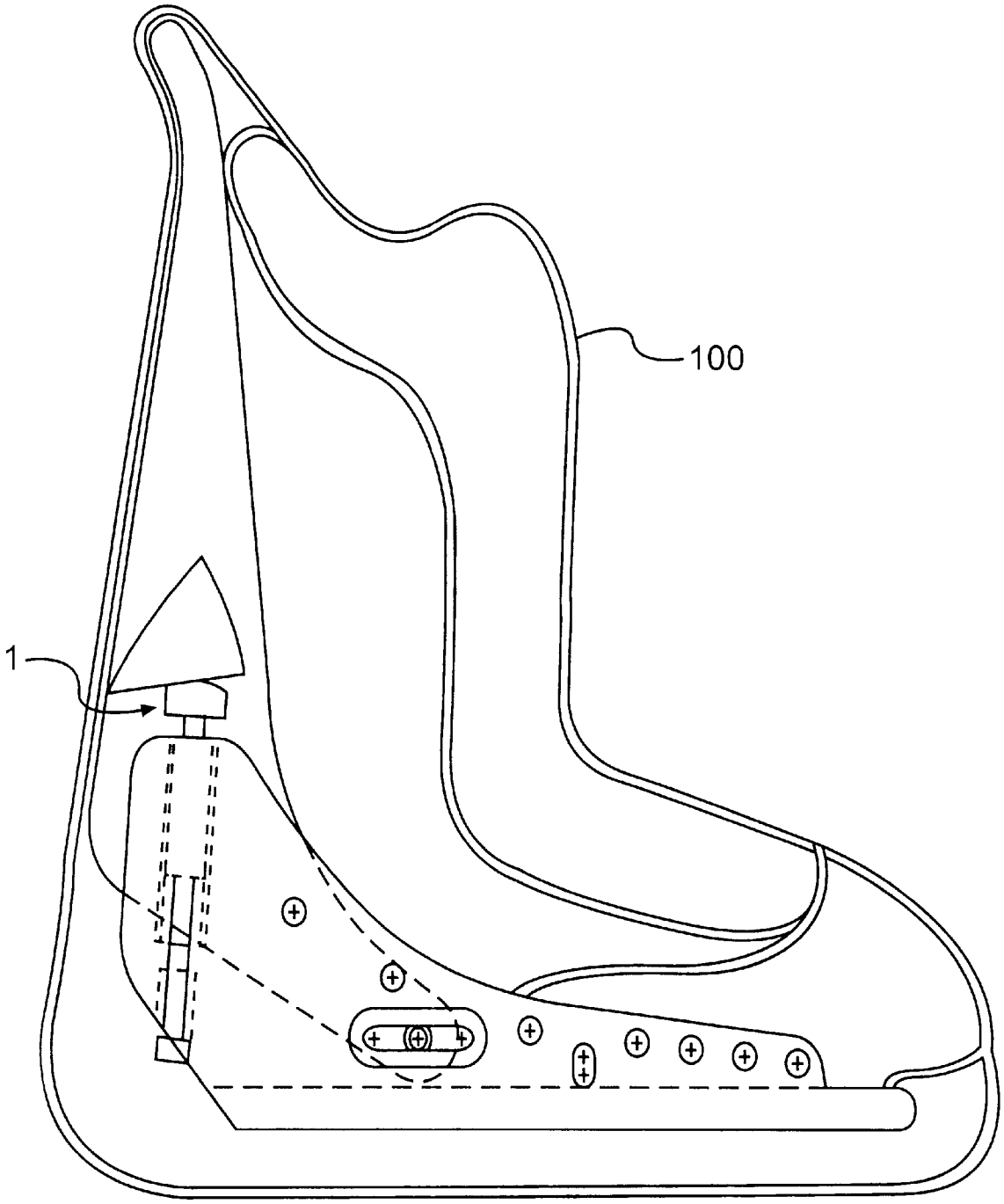
FIG. 15 illustrates a side view of a step-in boot system according to the third embodiment of the present invention.
Figure 16:
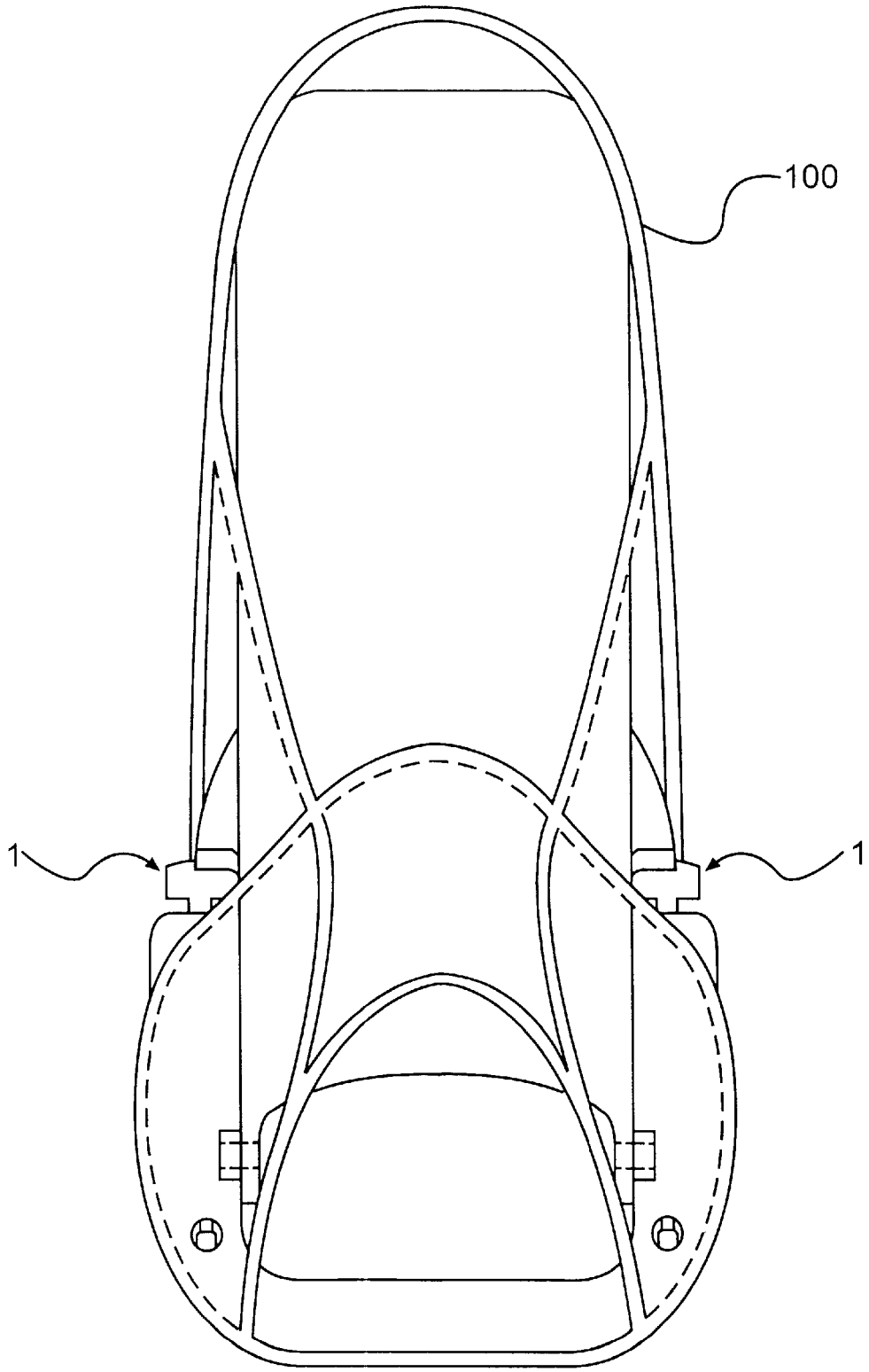
FIG. 16 illustrates a rear view of the step-in boot system according to the third embodiment of the present invention.

The present invention could also be embodied in a step-in system, such as that currently manufactured by Switch. A step-in system according to a third embodiment of the present invention is shown in FIGS. 15 and 16. With the step-in system, the GIR system would be built inside the boot as an internal skeleton. These boots currently have an internal skeleton made of kevlar or plastic.

As shown in FIGS. 15 and 16, boot 100 has resistance elements 1 incorporated into a binding system that forms an internal skeleton of the boot. The arrangement of resistance elements 1 is similar to the second embodiment of the present invention as illustrated in FIGS. 5–14, except for the routine modifications that are needed for the step-in system.

Figure 17:
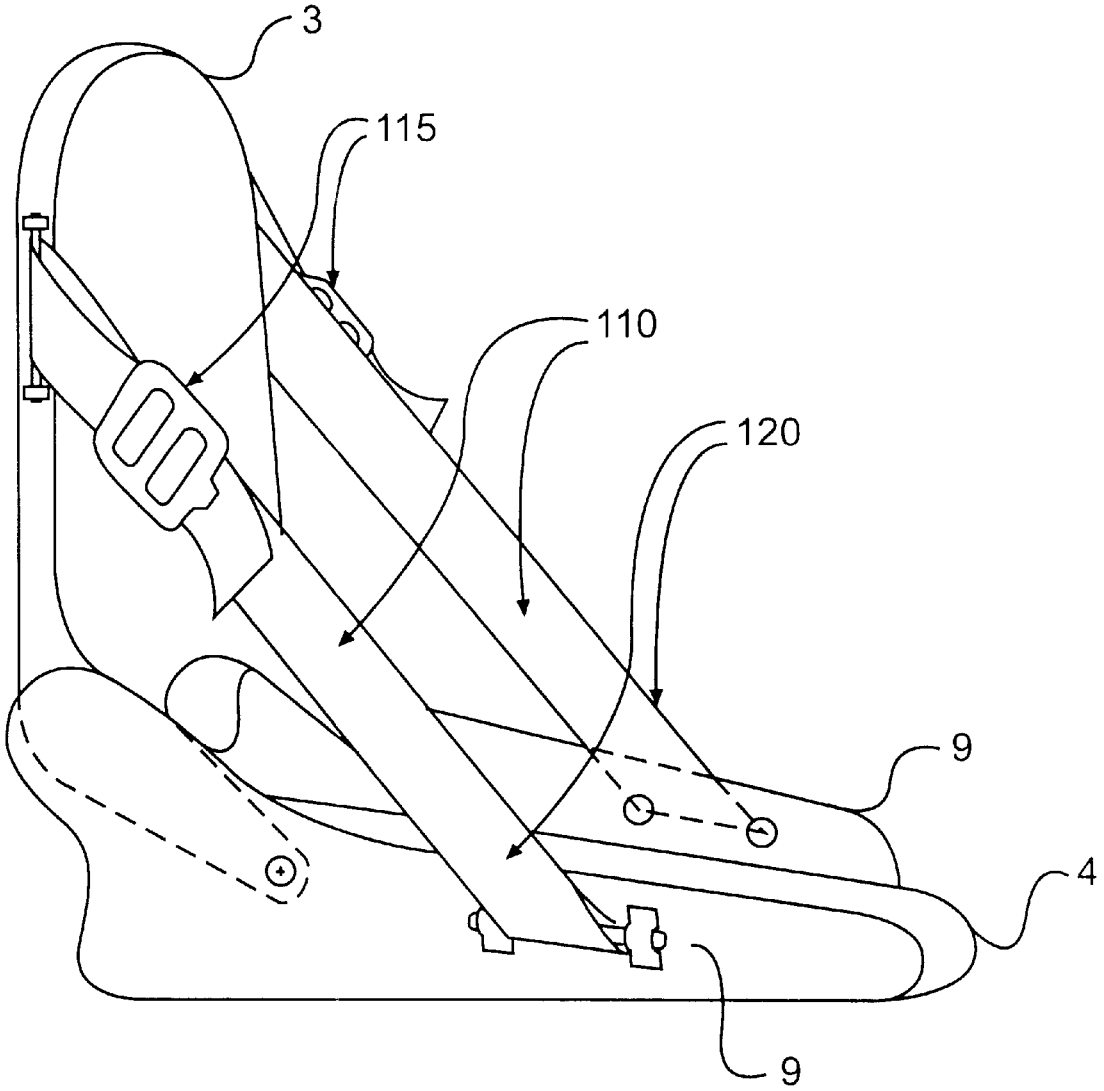
FIG. 17 illustrates a binding system using gradually increasing resistance straps according to a fourth embodiment of the present invention.

FIG. 17 illustrates a binding system incorporating gradually increasing resistance straps, or energy transfer straps, according to a fourth embodiment of the present invention. This embodiment may be most easily utilized within a step-in system as an internal skeleton of the boot. According to this fourth embodiment, gradually increasing resistance straps 110 are connected between the highback 3 and the side walls 9 of the base plate 4. A forward lean adjuster straplock 115 is used to set the forward lean of the highback 3 with respect to the baseplate 4. An expandable portion 120 of the straps 110 is made of a material having elastic properties similar to rubber. The thickness of this expandable portion can be varied based upon the weight of the rider. While the expandable portion 120 is shown on a portion of the strap 110 close to the baseplate 4, it should be understood that other portions of the strap can also be used. The straps 110 are preferably made of a synthetic webbing, or the like, except for expandable portion 120. This embodiment can functionally achieve results similar to the second embodiment of the present invention.

Figure 21:
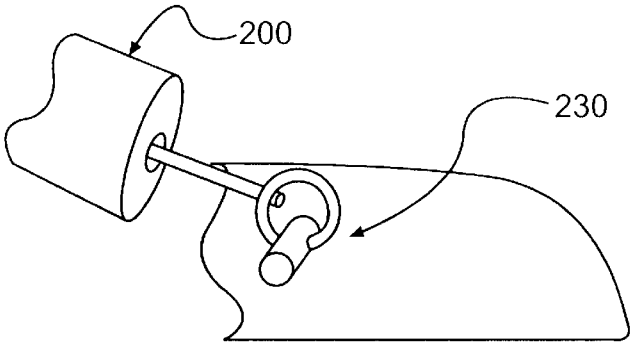
FIG. 21 illustrates the resistance element of FIG. 20 with a different type of attachment.
Figure 22:
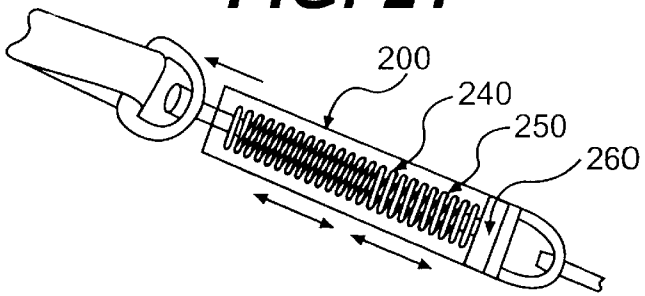
FIG. 22 illustrates another type of resistance element used in the fifth embodiment.
Figure 23:
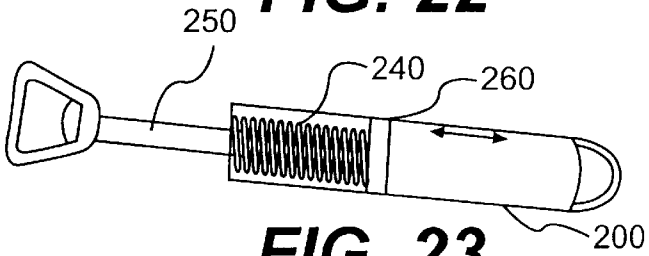
FIG. 23 illustrates the resistance element of FIG. 22 with a spring in a compressed state.
Figure 20:
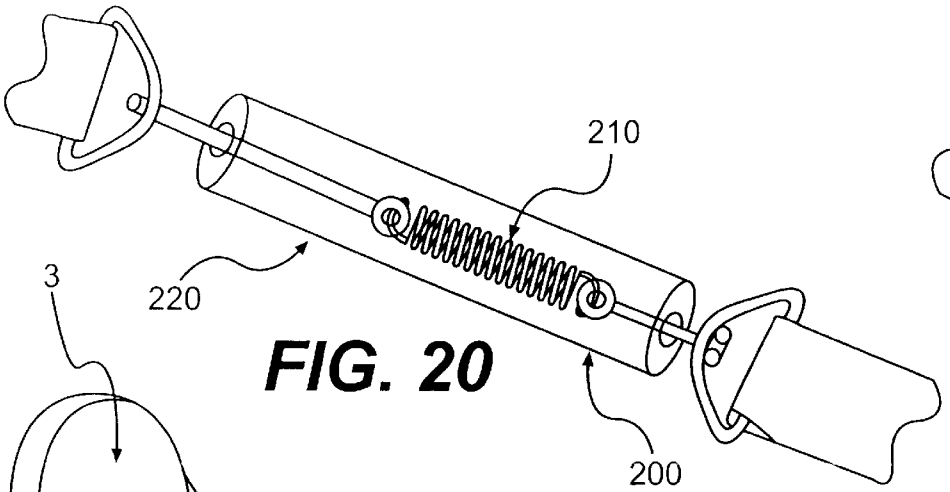
FIG. 20 illustrates one type of resistance element used in the fifth embodiment.
Figure 19:
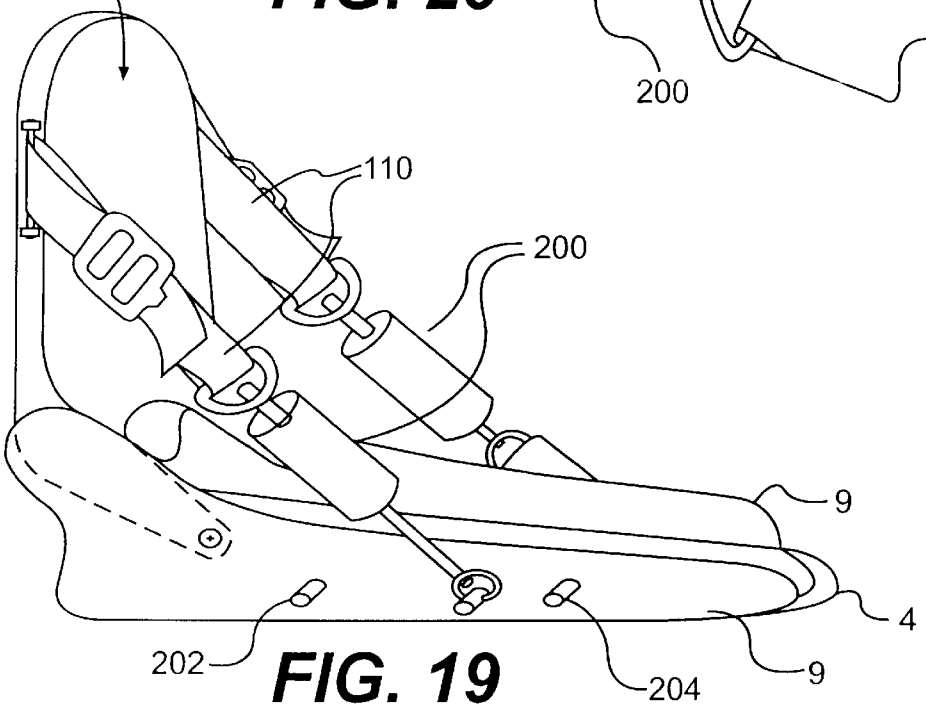
FIG. 19 illustrates a binding system using resistance elements according to a fifth embodiment of the present invention.

FIG. 19–23 illustrate an energy transfer system attached to a binding according to a fifth embodiment of the present invention. FIG. 19 illustrates an embodiment similar to that of FIG. 17, whereby one end of straps 110 are connected to the highback 3. However, in this embodiment, the other end of straps 110 are connected to energy transfer elements 200, which in turn are connected to sides 9 of baseplate 4. The point at which energy transfer elements 200 are connected to the sides 9 is variable depending upon the location along the sidecut and camber and can be at positions indicated by numerals 202, 203 and 204, for example. Energy transfer element 200 can be constructed in different versions as shown in FIGS. 20–23, for example. According to one version illustrated by FIGS. 20 and 21, elements 200 can be formed from providing an extension spring 210 within a housing 220. FIG. 21 illustrates a different type of attachment 230 than that shown in FIG. 20. According to another version illustrated by FIGS. 22 and 23, elements 200 can be formed by mounting a compression spring 240 on a shaft 250 having a head 260. Head 260 compresses spring 240 when a rider leans back, thereby providing gradually increasing resistance. FIG. 23 illustrates spring 240 in a compressed state.

Figure 26:
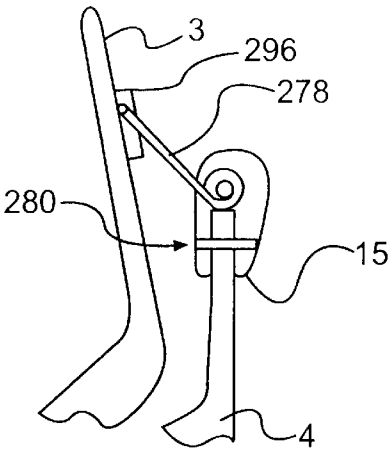
FIG. 26 illustrates a cross-sectional view of FIG. 24 taken along the lines 26—26.
Figure 25:
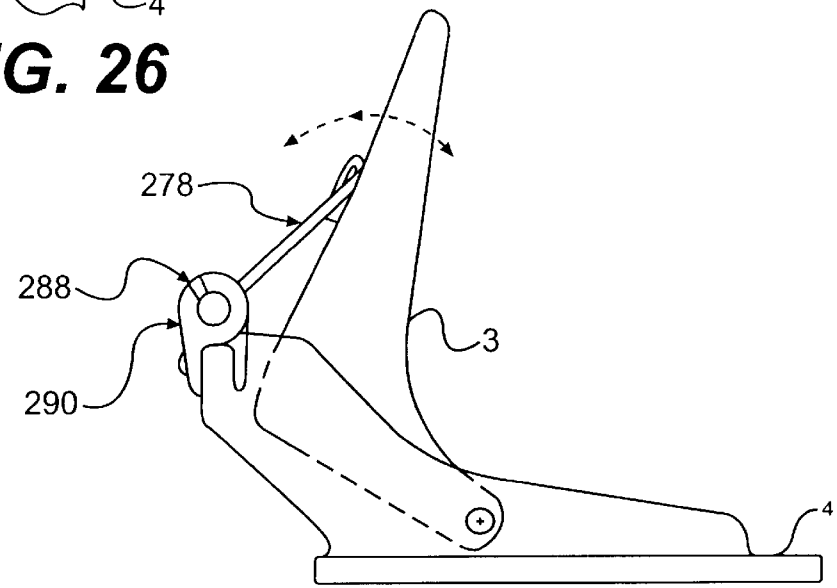
FIG. 25 illustrates a side view of the binding system of FIG. 24.
Figure 24:
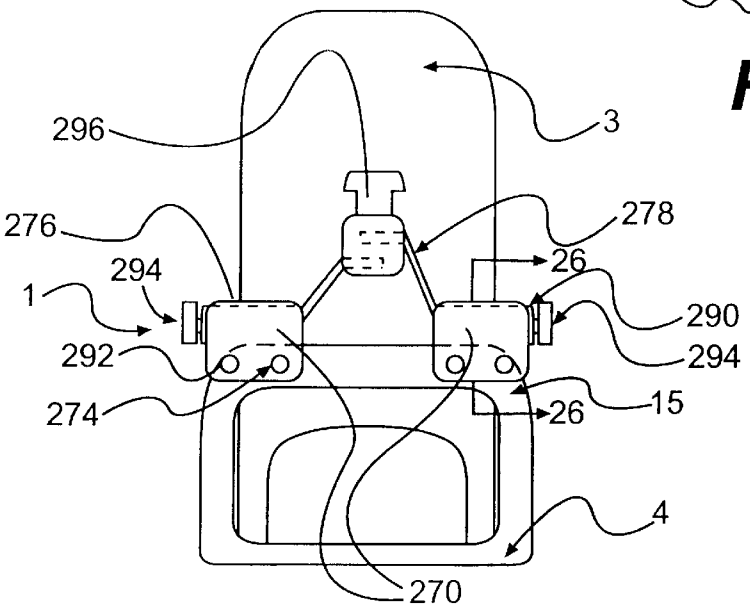
FIG. 24 illustrates a rear view of a binding system with a resistance element according to a sixth embodiment of the present invention.

FIGS. 24–26 illustrate an energy transfer system attached to a binding according to a sixth embodiment of the present invention. According to this embodiment, a pair of torsion springs 270 provide gradually increasing resistance and enable energy transfer from the rider to the snowboard. The heelcup has an upper lip 15 which is molded to act as a lower housing 274 for springs 270. The upper housing 276 is a separate piece secured to the heelcup and placed over the torsion springs 270. A torsion spring bar 278 emerges from the inside end of housing 276 and extends up to a molded slot in molded housing 296 attached to the highback 3, as shown in FIG. 26. A short torsion spring bar 288 emerges from housing 276 and is secured to a forward lean faceplate disk 290, which in turn in connected to forward lean adjuster 294. By turning disk 290, the angle of torsion spring bar 278 is varied, thereby setting the forward lean. Instead of using a detachable spring bar as shown, a double spring bar could be used in conjunction with a detachable spring bar housing on the highback 3. Screws 292 attach the spring housing to the heelcup.

The GIR System is a new breakthrough in snowboarding technology. It is a forward lean system gauged to work in coordination with a snowboards sidecut radius and camber, which is what makes the board turn. All forward lean adjustments to date are adjustable to different fixed positions. The idea of forward lean is to give a rider leverage against his or her calf muscles in order to put the snowboard up on edge, in order to make heelside turns.

The problem with forward lean in a fixed position is that the highbacks dig into the back of the rider's leg causing leg pain and foot fatigue. Also, with highbacks in a fixed position none of the energy is absorbed and transformed through the bindings. The pressure just goes directly to the board's edge. This limits the turning radius to the amount of sidecut and camber the snowboard provides. The GIR System solves this problem by allowing the rider to adjust the forward lean to the most desirable angle without being in a fixed position. This way when the rider makes the transition from a toeside turn into a heelside turn, the highback flexes with the rider's leg, softly at first, but becoming stiffer throughout the arc of the riderts turn. Thus, blending the flex of the bindings into the flex of the board increases the turning radius and increases comfort and control.

Due to the spring loading, not only can the rider gain the desired amount of forward lean, but, can also adjust the pretension for his or her particular weight. Furthermore, adjustments can be made based upon snow conditions, such as being stiffer on hardpack or ice and softer in powder.

The GIR System gives riders greater heel edge control and enhanced performance by blending the flex of the bindings into the flex of the board. Sometimes when making a hard heel edge turn, the rider will reach a maximum with respect to the sidecut and camber. If the rider doesn't release the weight and start to turn the other way in time, the snowboard will start to chatter and skip out from under the rider.

This happens because there is no time for the side cut and camber to recover between skips. But, with the GIR system fully compressed at the apex of the turn, if the board starts to chatter the springs react and instantly reset the sidecut and camber. Bear in mind, however, that the bindings are usually centered over the sidecut and camber. So, when the rider is leaning back into a heel edge turn, the springs are compressed under about 160 pounds of pressure, for example, and when the snowboard leaves the snow they snap right back into their starting position. This allows completion of a harder heel edge turn with greater control.

Another benefit of the GIR system is magnified tail snap. Tail snap can occur normally just from the sidecut, camber and flex of the snowboard. More specifically, when a rider sinks down into a turn and presses the snowboard through a turn, if the rider releases the pressure at just the right time, the energy generated will snap the rider up and into the next turn. This is seen most often in powder, where the rider appears to bounce from one turn to the next leaving the ground between turns. The GIR System can greatly enhance this effect.

While the present invention has been described above in connection with the preferred embodiments, one of ordinary skill in the art would be enabled by this disclosure to make various modifications to these preferred embodiments and still be within the scope and spirit of the present invention as recited in the appended claims.

What is claimed is:

1. A snowboard binding system for a snowboard comprising:

a snowboard binding which is to be mounted onto the snowboard to accommodate a snowboard boot worn by a rider; and resistance means incorporated into the snowboard binding for enhancing a turning radius of the snowboard on heel side turns, absorbing chatter and shock, and increasing mobility.

2. A snowboard binding system comprising:

a snowboard binding which is to be mounted onto a snowboard to accommodate a snowboard boot worn by a rider; and a resistance element incorporated with said snowboard binding, to absorb energy during a heel side turn, wherein the resistance element comprises:

a housing;

a control spring placed within a first end of the housing;

an adjuster block placed within a second end of the housing in abutting relation with the control spring; and a bolt passing through the control spring and threaded into a first end of the adjuster block.

3. The snowboard binding system according to claim 2, wherein said resistance element further comprises:

a lean adjuster threaded into a second end of the adjuster block.

4. A snowboard boot binding system including a snowboard binding which is to be mounted onto a snowboard to accommodate a snowboard boot worn by a rider, said snowboard binding comprising:

a base plate having first and second sidewalls;

a highback pivotally connected to the base plate; and a first resistance element providing gradually increasing resistance and being connected between the base plate and the highback, the first resistance element absorbing energy during a heel side turn and releasing the absorbed energy at the end of the turn.

5. A snowboard boot binding system according to claim 4, wherein the first resistance element includes a control spring.

6. A snowboard boot binding system according to claim 4, wherein the first resistance element is a strap having an expandable portion made of an elastic material.

7. A snowboard boot binding system according to claim 4, further comprising a second resistance element, wherein the first and second resistance elements are connected to the first and second sidewalls of the baseplate, respectively.

8. A snowboard boot binding system according to claim 7, wherein the first and second resistance elements each have a control spring.

9. A snowboard boot binding system according to claim 7, wherein the first and second resistance elements are straps having expandable portions made of an elastic material.

10. A step-in boot incorporating the snowboard boot binding system of claim 9.

11. A snowboard boot binding system according to claim 10, wherein the first resistance element further comprises:

a lean adjuster threaded into a second end of the adjuster block.

12. A step-in boot incorporating the snowboard boot binding system of claim 7.

13. A step-in boot incorporating the snowboard boot binding system of claim 4.

14. A snowboard boot binding system according to claim 4, wherein the first resistance element comprises:

a housing;

a control spring placed within a first end of the housing;

an adjuster block placed within a second end of the housing in abutting relation with the control spring; and a bolt passing through the control spring and threaded into a first end of the adjuster block.

15. A binding for use with a snowboard having a heel turn edge and a toe turn edge, said binding comprises:

a boot sole support member which can be fixedly secured to a snowboard;

a heel and leg support member hinged to the sole support member and movable through an angle or arc in relation to said sole support member; and energy storage means connected between said sole support member and said heel and leg support member for absorbing and transferring energy to the heel edge of said board as a heel turn is initiated and carried out, and then releasing at least a portion of said energy in the transition between the conclusion of the heel turn and the initiation of a toe turn.

16. A binding for use with a snowboard having a heel turn edge and a toe turn edge, said binding including a boot sole support member which can be fixedly secured to a snowboard, and a heel and leg support member hinged to said sole support member and movable through an angle or arc in relation to said sole support member, the improvement comprising:

energy storage means connected between said sole support member and said heel and leg support member for absorbing and transferring energy to the heel edge of said board as a heel turn is initiated and carried out, and then releasing at least a portion of said energy in the transition between the conclusion of the heel turn and the initiation of a toe turn.

* * * * *